US006978832B2

(12) United States Patent
Gardner et al.

(10) Patent No.: US 6,978,832 B2
(45) Date of Patent: Dec. 27, 2005

(54) DOWNHOLE SENSING WITH FIBER IN THE FORMATION

(75) Inventors: Wallace R. Gardner, Houston, TX (US); Paul F. Rodney, Spring, TX (US); Neal G. Skinner, Lewisville, TX (US); Vimal V. Shah, Sugar Land, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/238,005

(22) Filed: Sep. 9, 2002

(65) Prior Publication Data

US 2004/0045705 A1 Mar. 11, 2004

(51) Int. Cl.[7] ..... E21B 47/00

(52) U.S. Cl. ..... 166/250.1; 166/250.01; 166/305.1; 166/308.1

(58) Field of Search ..... 166/380, 250.01, 166/250.02, 250.16, 252.2, 113, 384, 308, 166/250.1, 305.1

(56) References Cited

U.S. PATENT DOCUMENTS

| | | | | |
|---|---|---|---|---|
| 4,896,997 | A * | 1/1990 | Gaylin | 405/156 |
| 5,713,700 | A * | 2/1998 | Vogelsang | 405/183.5 |
| 5,767,411 | A | 6/1998 | Maron | |
| 5,892,860 | A | 4/1999 | Maron et al. | |
| 5,925,879 | A | 7/1999 | Hay | |
| 5,973,317 | A | 10/1999 | Hay | |
| 5,986,749 | A | 11/1999 | Wu et al. | |
| 5,992,250 | A * | 11/1999 | Kluth et al. | 73/866.5 |
| 6,016,702 | A | 1/2000 | Maron | |
| 6,041,872 | A | 3/2000 | Holcomb | |
| 6,227,114 | B1 | 5/2001 | Wu et al. | |
| 6,233,746 | B1 | 5/2001 | Skinner | |
| 6,252,656 | B1 | 6/2001 | Wu et al. | |
| 6,271,766 | B1 | 8/2001 | Didden et al. | 340/853.1 |
| 6,281,489 | B1 | 8/2001 | Tubel et al. | |
| 6,317,540 | B1 * | 11/2001 | Foulger et al. | 385/100 |
| 6,408,943 | B1 * | 6/2002 | Schultz et al. | 166/285 |
| 6,437,326 | B1 | 8/2002 | Yamate et al. | |
| 6,644,402 | B1 | 11/2003 | Sharma et al. | |
| 6,648,552 | B1 * | 11/2003 | Smith et al. | 405/129.55 |
| 2003/0094281 | A1 * | 5/2003 | Tubel | 166/250.03 |
| 2003/0205376 | A1 * | 11/2003 | Ayoub et al. | 166/254.2 |

FOREIGN PATENT DOCUMENTS

| | | | | |
|---|---|---|---|---|
| FR | 2697283 | A1 * | 4/1994 | E21B 47/12 |

* cited by examiner

*Primary Examiner*—David Bagnell
*Assistant Examiner*—Giovanna M. Collins
(74) *Attorney, Agent, or Firm*—John W. Wustenberg; McAfee & Taft

(57) ABSTRACT

A portion of at least one fiber is moved from a wellbore into a formation such that the portion is placed to conduct a signal responsive to at least one parameter in the formation. One particular implementation uses fiber optic cable with a process selected from the group consisting of a fracturing process, an acidizing process, and a conformance process.

43 Claims, 5 Drawing Sheets

DOWNHOLE SENSING WITH FIBER IN THE FORMATION

BACKGROUND OF THE INVENTION

This invention relates generally to sensing conditions in a formation outside a well. It relates more particularly to sensing, such as with optical fiber technology, one or more formation parameters at least during a fracturing, acidizing, or conformance treatment.

Service companies in the oil and gas industry strive to improve the services they provide in drilling, completing, and producing oil and gas wells. Fracturing, acidizing, and conformance treatments are three well-known types of services performed by these companies, and each of these entails the designing, producing, and using of specialized fluids. It would be helpful in obtaining, maintaining, and monitoring these to know downhole conditions as these fluids are being placed in wells and out into formations communicating with the wells. Thus, there is a need for sensing these conditions and obtaining data representing these conditions from down in the formations at least as the fluids are being placed (that is, in real time with the treatment processes); however, post-treatment or continuing sensing is also desirable (such as for trying to determine when a formation might plug due to scale build-up, for example). Such need might include or lead to, for example, monitoring pressure and other parameters inside a fracture, monitoring fracture propagation into water-bearing formations, determining the fracture opening and closing pressures, and making real-time changes in treatment methods to increase well productivity.

SUMMARY OF THE INVENTION

One aspect of the present invention is as a method of enabling sensing of at least one parameter in a formation communicating with a wellbore. This method comprises moving a portion of at least one fiber optic cable from the wellbore into the formation such that the portion is placed to conduct an optical signal responsive to at least one parameter in the formation.

Such a method can be more particularly defined as comprising: moving a fiber optic sensor from the wellbore into the formation outside the wellbore; conducting light to the fiber optic sensor from a light source; and receiving an optical signal from the fiber optic sensor in response to the conducted light and at least one parameter in the formation.

The present invention also provides a method of treating a well, comprising: using, during a treatment time period, a process selected from the group consisting of a fracturing process, an acidizing process, and a conformance process; moving a disposable fiber optic sensor into a formation undergoing the treatment with the fluid of the process used from the group consisting of a fracturing process, an acidizing process, and a conformance process; and sensing with the disposable fiber optic sensor at least one parameter of the formation.

It is to be further understood that other fiber media can be used within the scope of the present invention.

Various objects, features, and advantages of the present invention will be readily apparent to those skilled in the art in view of the foregoing and the following description read in conjunction with the accompanying drawings.

BRIEF DESCRIPTION OF THE DRAWINGS

FIG. 6 represents a fiber optic cable carried into a well and a formation from a fiber-dispensing device at the surface.

DETAILED DESCRIPTION OF THE INVENTION

Figure 1:
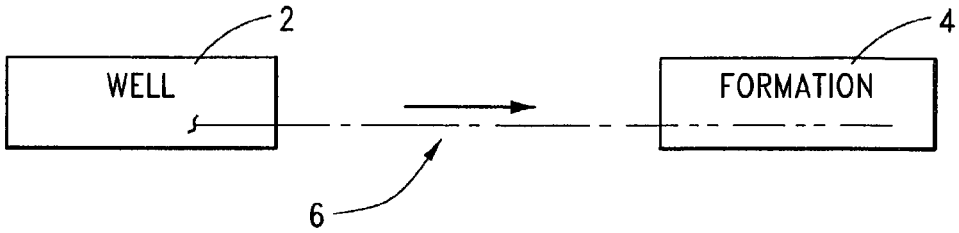
FIG. 1 represents a well and a formation in communication with each other wherein a portion of at least one fiber is moved from the well into the formation, one example of such fiber being fiber optic cable to which the remaining drawings will refer.

Referring to FIG. 1, a well 2 and a formation 4 communicate with each other such that a respective portion of one or more fibers can be placed from the well 2 to the formation 4 in accordance with the present invention (only one fiber is shown in the drawings for simplicity). Such fiber and the present invention will be further described with reference to one or more fiber optic cables 6 as the presently preferred embodiment of fiber (the term "fiber optic cable" as used in this description and in the claims includes the cable's optical fiber or fibers, which may alone have parameter sensing capabilities, as well as any other sensor devices integrally or otherwise connected to the optical fiber(s) for transport therewith, as well as other components thereof, such as outer coating or sheathing, for example, as known to those skilled in the art). The portion of the illustrated fiber optic cable 6 is moved from the well 2 into the formation 4 such that the fiber optic cable 6 is placed to conduct a signal responsive to at least one parameter in the formation 4. The parameter to be measured can be any one or more phenomena that can be sensed using fiber optic technology or technology compatible therewith. Non-limiting examples are pressure, temperature, and chemical activity (for example, chemical and ionic species, and chemical build-up such as scaling). Movement of the fiber optic cable 6 is represented by the arrow shown in FIG. 1 and the sequential displacements represented by the solid, dot dash, and double-dot dash line formatting used in FIG. 1.

Figure 2:
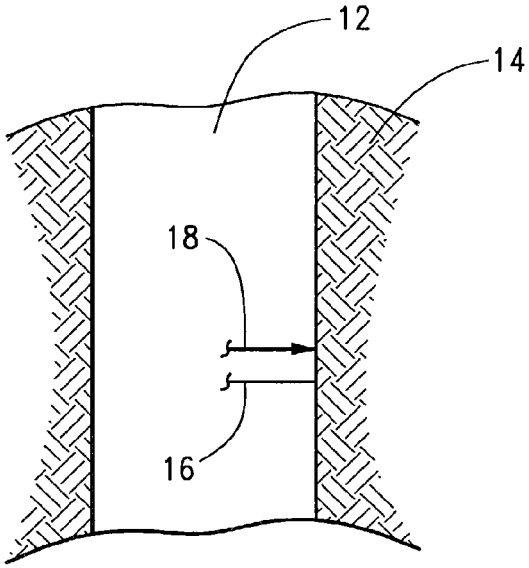
FIG. 2 is a schematic representation of a fluid moving in a well such that the fluid pulls along with it a portion of fiber optic cable.

The fiber optic cable 6 can be moved by any technique suitable for transporting fiber optic cable into a subterranean formation from a well. One technique of moving the fiber optic cable 6 includes flowing a fluid into the formation 4 and carrying by the flowing fluid the portion of the fiber optic cable 6 into the formation 4. This is represented in FIG. 2 by a fluid 18 carrying a fiber optic cable 16 from a well 12 into a formation 14 intersected by the well 12. Although one fiber optic cable 16 may be enough to be carried into the formation 14, such as specifically into a fracture in the formation 14, multiple circumferentially oriented cables can be used to ensure interception by the flowing fluid 18 and transport into the desired part of the formation 14 (for example, three fiber optic cables positioned or oriented 120° apart relative to the circumference of the well 12 such that at least one of them moves into a respective fracture with flowing fracturing fluid 18).

The fluid 18 can be of any type having characteristics sufficient to carry at least one fiber optic cable 16 in accordance with the present invention. Such fluid 18 can be at different pressures and different volume flow rates (for example, hydraulic fracturing, hydraulic lancing); however, some specific inventive embodiments are particularly directed to fluids used in a fracturing process, an acidizing process, or a conformance process. These processes and fluids are known in the art.

Figure 3:
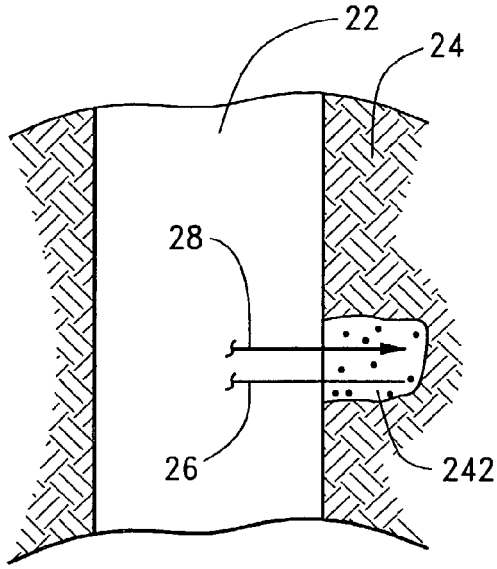
FIG. 3 represents moving fluid in a well acting both to fracture an adjacent formation and to carry fiber optic cable into the fracture.

FIG. 3 illustrates a fracturing fluid 28 used for hydraulically creating a fracture 242 in a formation 24 intersected by a well 22. Typically, such fracturing also includes transporting proppant into the fracture 242 as part of the fracturing fluid 28. In the FIG. 3 embodiment, fracturing the formation 24 is performed using the fracturing fluid 28 under pressure, which fracturing fluid 28 also moves a fiber optic cable 26. This typically includes pumping the fracturing fluid 28 such that it fractures the formation 24 and such that it engages and pulls the fiber optic cable 26 as the fracturing fluid 28 flows.

Figure 4:
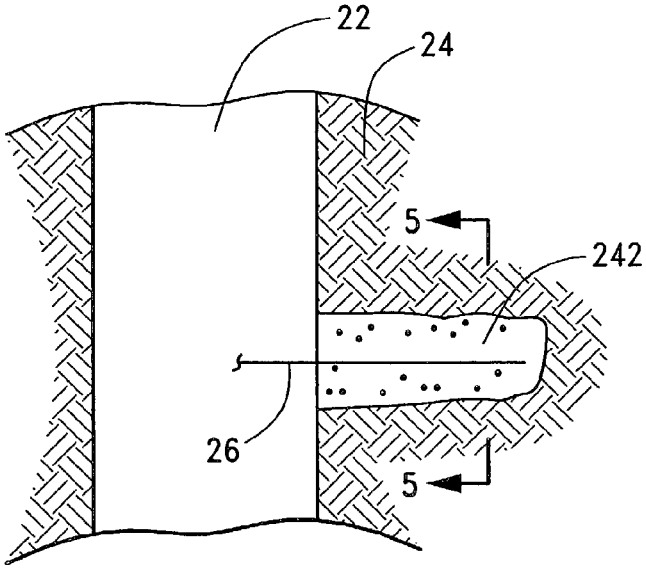
FIG. 4 represents a portion of the fiber optic cable as moved from the well into the fracture and left there.
Figure 5:
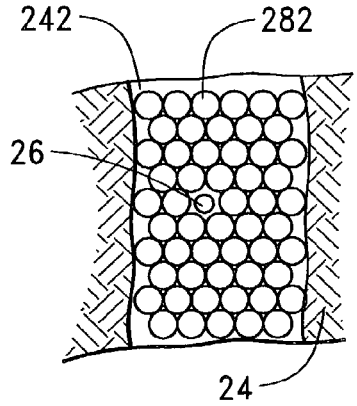
FIG. 5 is a view along line 5—5 in FIG. 4 showing that the outer diameter of the illustrated fiber optic cable is less than diameters of adjacent proppant carried into the fracture in the fracturing fluid.
Figure 5:
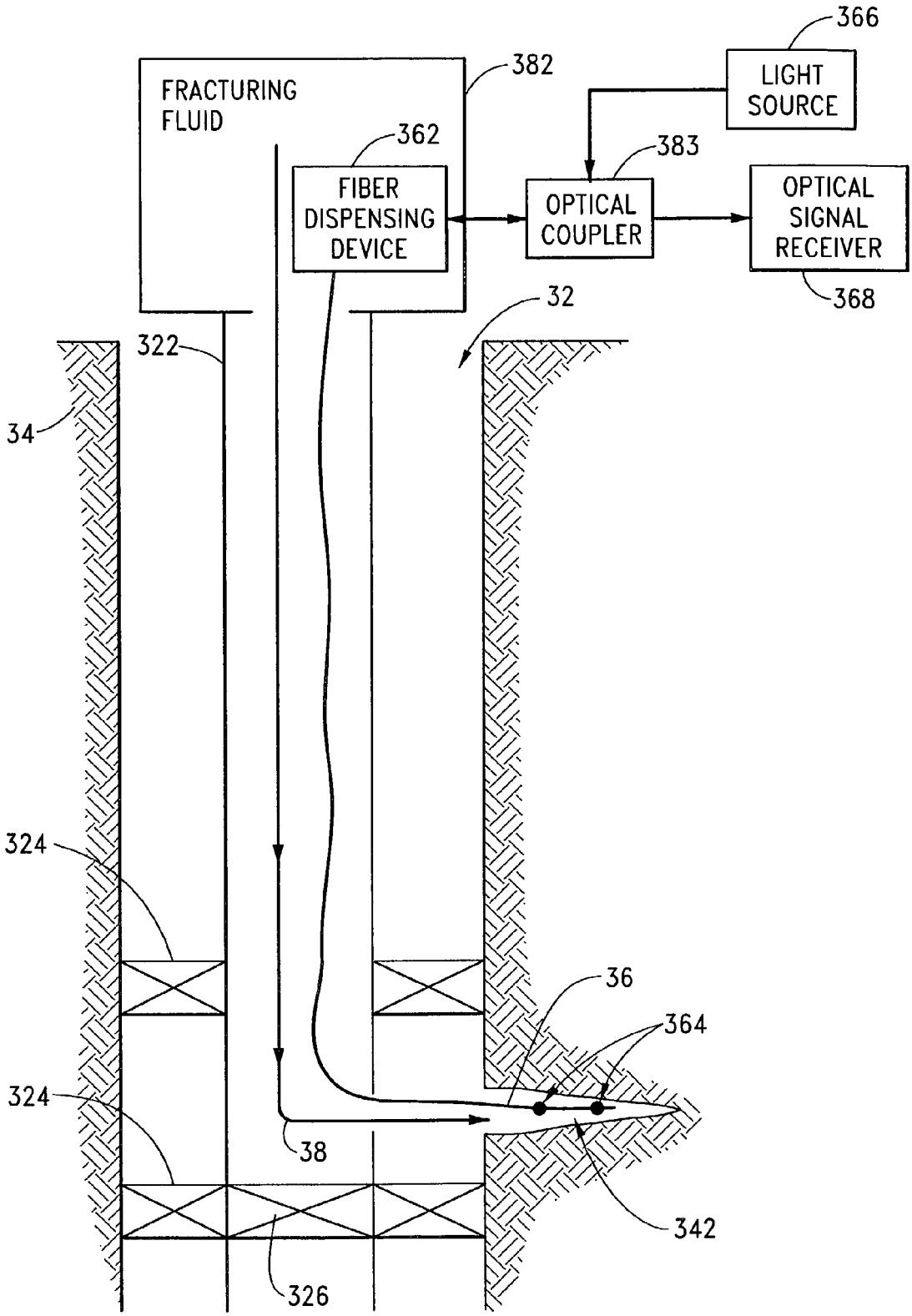

FIG. 4 represents a later stage in the fracturing process of FIG. 3, namely, after the hydraulic fracturing is finished and a portion of the fiber optic cable 26 is left in place in the fracture 242. FIG. 5 illustrates the fiber optic cable 26 disposed among proppant 282 in the fracture 242; it also illustrates a preferred size of the fiber optic cable 26 for such fracturing application, namely, wherein its outer diameter is smaller than the outer diameter of whole particles of proppant 282.

Referring to FIG. 6, a well 32 intersects a formation 34 having a fracture 342. Disposed in the well 32 are a pipe or tubing string 322, packers 324, and a plug 326, each of which is of a type and use known in the art.

A fiber optic cable 36 is moved into the fracture 342 by a fracturing fluid 38. The fracturing fluid 38 comes from a fracturing fluid system 382 that includes one or more pumps as known in the art. In the FIG. 6 embodiment, associated with the fracturing fluid system 382 is a fiber dispensing device 362. In one implementation this includes a spool of the fiber optic cable 36 housed such that the fiber optic cable 36 readily unspools, or uncoils, (at least a portion of it) as the fracturing fluid 38 is pumped along or through it. An end of the fiber optic cable 36 remains at the original spool location, and that end is connected through an optical coupler 383 (which splits and couples light signals as known in the art) to a light source 366 and an optical signal receiver 368.

This embodiment involves the deployment of disposable fiber optic cable 36 with integral fiber optic sensors 364 (or in which the fiber itself is the sensor) into the fracture 342 during the fracturing treatment. The fiber optic cable 36 is unspooled from the uphole fiber dispensing device 362 and carried into the producing zone by the fracturing fluid 38. The fiber dispensing device 362 is located uphole inside the fluid reservoir from which the fracturing fluid 38 is pumped.

The viscous drag of the fracturing fluid 38 unspools and transports the leading end of the fiber optic cable 36 down the well 32 inside the pipe or tubing string 322 that carries the fracturing fluid 38 and then into the fractured formation 34. This leading end of the fiber optic cable 36, with its sensors 364 or intrinsic sensing fiber, is dispensed into the fractured formation 34 when the formation 34 is initially over pressured. When the fracturing pressure is subsequently reduced, the formation 34 begins to close at a pressure just below the optimal fracturing pressure. The fracture pressure can then be continually monitored by the sensing portion of the fiber optic cable 36 to enhance the fracturing service. That is, as the fracturing fluid 38 is pumped into the well under pressure to fracture the selected formation 34, the fracturing fluid 38 carries the leading end of the fiber optic cable 36, exerts pressure against the formation 34 and thereby fractures it, and flows into the created fracture 342 (carrying the fiber optic cable 36, and proppant if any) to extend the fracture 342. At a selected time, pumping is stopped and the well 32 is shut-in under pressure. Eventually, pressure is released by opening the well 32, which allows the formation 34 to close to some extent (but not fully as typically propped open by the proppant). During this closing, fluid flow back to the surface occurs and the emplaced fiber optic cable 36 is crushed with the proppant, whereby optical reflective properties of this portion of the fiber optic cable 36 change. This affects the optical signal returned by the fiber optic cable 36 (specifically, the sensors 364 or sensing portion thereof), whereby the fracture closure pressure can be measured in real time during the fracturing process.

The light source 366 and optical signal receiver 368 are located uphole and are connected to the fixed end of the fiber optic cable 36 at the fiber-dispensing device 362. As one type of signal, light reflecting back from the sensors 364 (or intrinsic sensing portion) constitutes an optical signal that contains information regarding pressure and temperature, for example, which is assessed uphole. No downhole optical processing equipment is required in this embodiment. This simplifies the downhole portion of this system and places the optical signal processing equipment at the surface, away from high temperatures, pressures, mechanical shock and vibration, and chemical attack typically encountered downhole.

Figure 7:
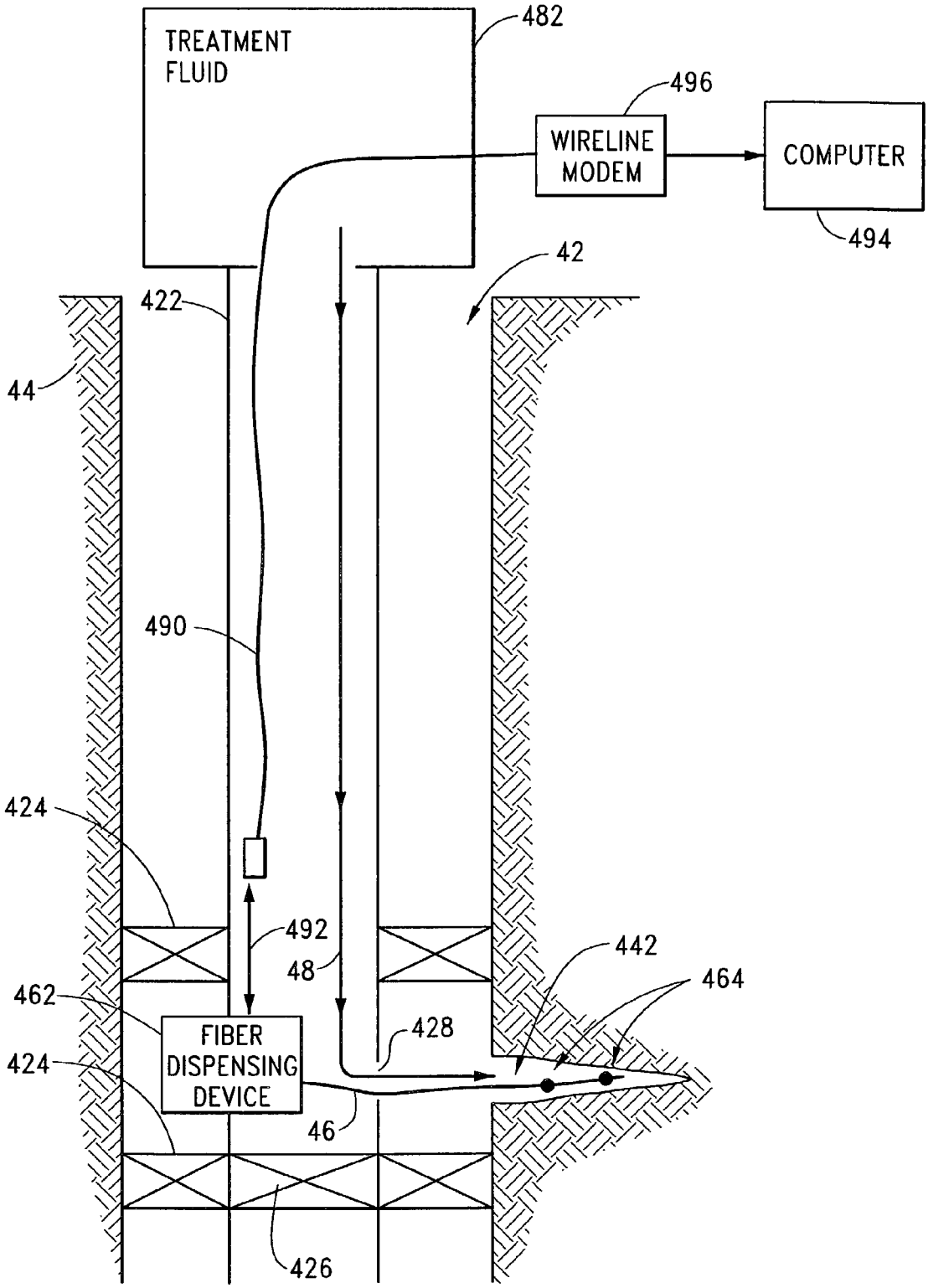
FIG. 7 represents a fiber optic cable carried into a formation from a fiber-dispensing device down in a well, in which well an optical source and signal receiver equipment is also located with a telemetry system to communicate information to the surface.
Figure 8:
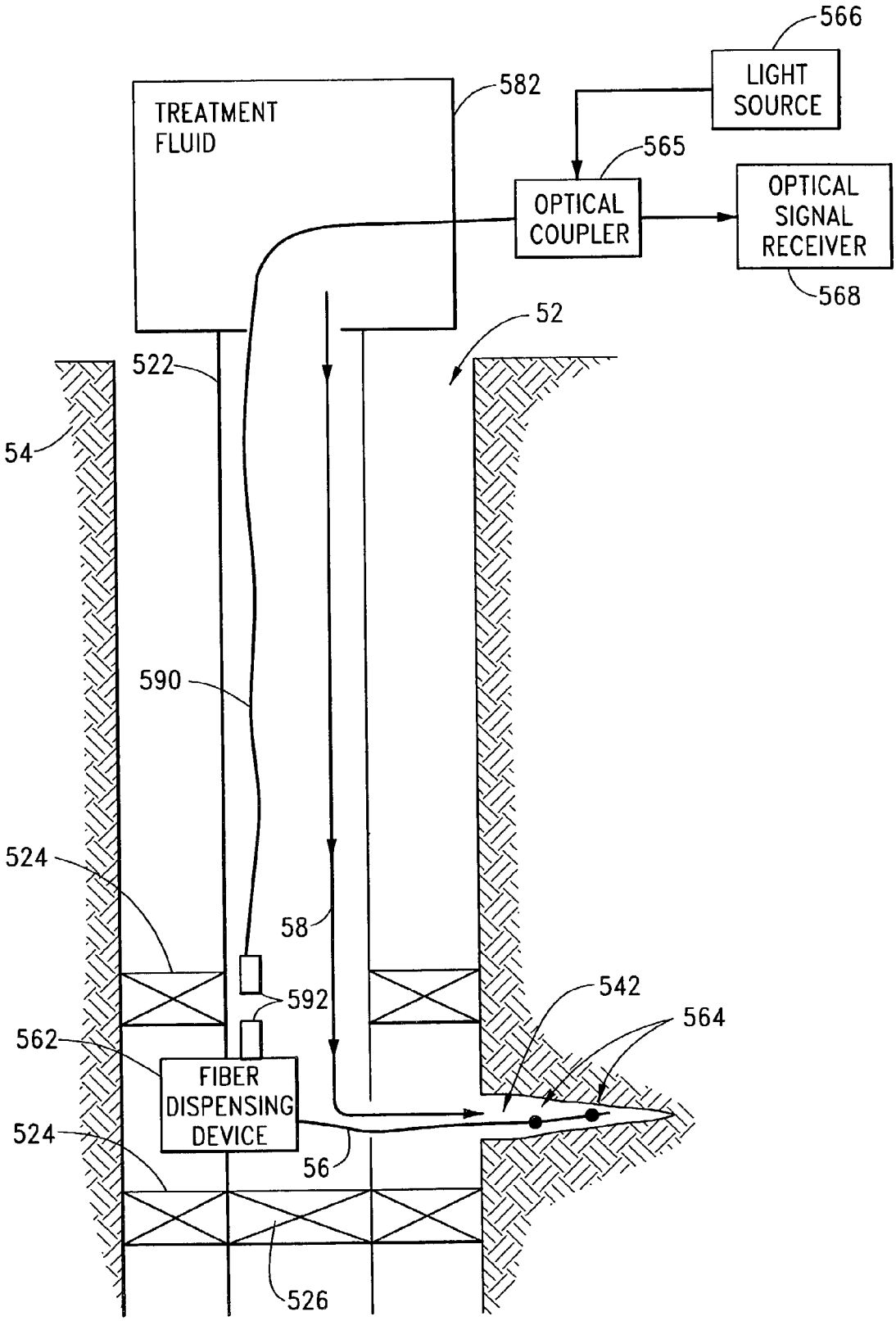
FIG. 8 represents a fiber optic cable carried into a formation from a fiber-dispensing device down in the well, in which well an optical telemetry system is also disposed to communicate optical source and responsive signals from and to the surface.

In FIGS. 7 and 8, the illustrated fiber optic cable is mounted in a fiber dispensing device, such as including a spool or coil of the fiber optic cable, that is located downhole. Each such downhole spool (for example) is mounted to allow its fiber optic cable to be pulled from it by the flowing fluid. In each of FIGS. 7 and 8, there are associated light source and measurement electronics that can be located either at the surface or downhole. Telemetry is provided to get signals from a downhole location to the surface. In the embodiment of FIG. 6, the fiber optic cable 36 is continuous to the surface so that the optical signal can be conducted along it; however, in the examples of FIGS. 7 and 8, there is a separate communication that must be effected from the downhole spool to the surface. Any suitable telemetry, whether wired or wireless, can be used. Non-limiting examples include electromagnetic telemetry, electric line, acoustic telemetry, and pressure pulse telemetry, not all of which may be suitable for a given application.

Referring to FIG. 7, a well 42 intersects a formation 44 having a fracture 442. Disposed in the well 42 are a pipe or tubing string 422, packers 424, and a plug 426, each of which is of a type and use known in the art.

A fiber optic cable 46 is moved into the fracture 442 by a treatment fluid 48 (that is, a fracturing, acidizing, or conformance fluid). The treatment fluid 48 comes from a treatment fluid system 482 that includes one or more pumps as known in the art. In the FIG. 7 embodiment, a fiber dispensing device 462, from which the fiber optic cable 46 (at least a portion of it) is pulled as the treatment fluid 48 is pumped along side it, is located down in the well 42.

In FIG. 7, the fiber dispensing device 462 is shown located downhole near ports or perforations 428 in the pipe or tubing string 422 (for example, lining or casing) through which the treatment fluid 48 is injected into the communicating formation 44. Using the downhole fiber dispensing device 462 enables a shorter overall length of fiber optic cable 46 to be used. For example, a length of from a few meters to in excess of 100 meters might be used downhole whereas from a surface-located spool (for example, fiber dispensing device 362), the fiber optic cable may need to have a length of several thousand feet. With the shorter length of fiber optic cable for a downhole fiber dispensing device, such device can be relatively small since such fiber optic cable is neither long nor needing to be of very large diameter because it does not need to survive the harsh environment for a long period of time. Any suitable fiber optic cable configuration may be used, one non-limiting example of which includes multiple spools of fiber optic cables deployed for a single treatment, wherein the length of fiber optic cable in each spool is different to enable penetration to various distances in the fracture.

In FIG. 7, the light source and optical measurement devices (not separately shown) are located downhole and are connected to the fixed end of the fiber optic cable 46 at the fiber dispensing device 462. Light reflecting from optical sensors 464 (or intrinsic sensing portion) contains information regarding pressure and temperature, for example.

A telemetry system relays such information to the surface. The telemetry technique illustrated in FIG. 7 includes an electric line 490. A radio frequency short hop link 492 may be used to relay the data from the optical detection equipment to the electric line 490. Alternatively, an electrical wet metallic connector may be used. Considering other non-limiting examples, wireless transmission methods such as acoustic telemetry through tubing or fluid, or electromagnetic telemetry, or a combination of any of these can also be used. By whatever means used, the signals are sent to surface equipment, such as a computer 494 (illustrated as via a wireline modem 496 when electric line 490 is used as illustrated in FIG. 7).

Referring to FIG. 8, a well 52 intersects a formation 54 having a fracture 542. Disposed in the well 52 are a pipe or tubing string 522, packers 524, and a plug 526, each of which is of a type and use known in the art.

A fiber optic cable 56 with integral fiber optic sensors 564 (or in which the fiber itself is the sensor) is moved into the fracture 542 by a treatment fluid 58 (that is, a fracturing, acidizing, or conformance fluid). The treatment fluid 58 comes from a treatment fluid system 582 that includes one or more pumps as known in the art. In the FIG. 8 embodiment, a fiber dispensing device 562, from which the fiber optic cable 56 is obtained (at least a portion of it is) as the treatment fluid 58 is pumped along or through it, is located in the well 52.

In FIG. 8, an optical wet connect 592 is used to establish the communication link between the downhole equipment and a wireline 590 that extends to the surface and the surface equipment. In the illustration of FIG. 8, the wireline 590 is armored and contains at least one optical fiber, one part of the optical wet connect 592, and a sinker bar. When this wireline tool stabs into the downhole tool containing the fiber dispensing device 562 and the other part of the optical wet connect 592, the fiber optic cable 56 is optically connected through the optical fiber(s) of the wireline 590 to the optical signal equipment (through optical coupler 565 to light source 566 and optical signal receiver 568) located at the surface in the FIG. 8 illustration. Thus, no downhole optical processing is required. This simplifies the downhole portion of the system and places the optical signal processing equipment at the surface, away from the adverse conditions typically found downhole.

So, the embodiments of FIGS. 6–8 illustrate that the respective fiber optic cable source can be located either in the wellbore or outside the wellbore (such as at the surface). To be placed in the formation, the respective fiber optic cable is pulled from its dispensing device, such as by the force of fluid flowing along and engaging it.

To use optical signaling in any of the aforementioned fiber optic cables 6, 16, 26, 36, 46, 56, 66, light is conducted to the fiber optic sensor portion thereof from a light source, and an optical signal from the fiber optic sensor is received in response to the conducted light and at least one parameter in the formation. Such signal includes a portion of the light reflected back from the sensor or sensing portion of the optical fiber, the nature of which reflected light is responsive to the sensed parameter. Non-limiting examples of such parameters include pressure, temperature, and chemical activity in the formation. The light source can be disposed either in the well or outside the well, and the same can be said for the optical signal receiver. Typically both of these would be located together; however, they can be separated either downhole or at the surface or one can be downhole and the other at the surface. The light source and the optical signal receiver can be of types known in the art. Non-limiting examples of a light source include broadband, continuous wave or pulsed laser or tunable laser. Non-limiting examples of equipment used at the receiving end include intrinsic Fabry-Perot interferometers and extrinsic Fabry-Perot interferometers. For multiple fiber optic sensors, the center frequency of each fiber optic sensor of a preferred embodiment is set to a different frequency so that the interferometer can distinguish between them.

The fiber optic cable 6, 16, 26, 36, 46, 56, 66 of the embodiments referred to above can be single-mode or multiple-mode, with the latter preferred. Such fiber optic cable can be silicon or polymer or other suitable material, and preferably has a tough corrosion and abrasion resistant coating and yet is inexpensive enough to be disposable. Such fiber optic cable does not have to survive the harsh downhole environment for long periods of time because in the preferred embodiment of the present invention it need only be used during the time that the treatment process is being applied; however, broader aspects of the present invention are not limited to such short-term sensing (for example, sensing can occur as long as the fiber sensor functions and related equipment is in place and operating). This longer term sensing can be advantageous, such as to monitor for scaling in the formation.

Figure 9:
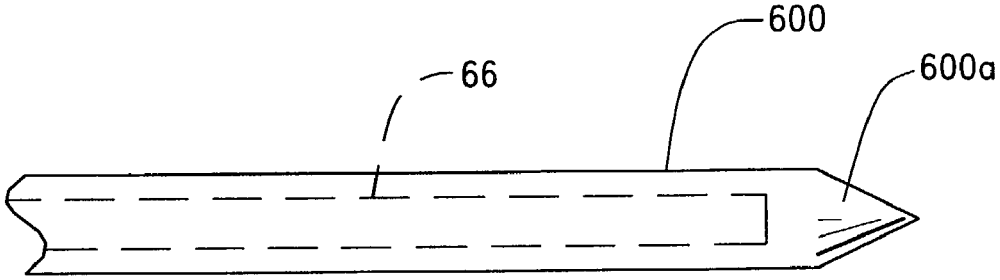
FIG. 9 represents a leading end of a fiber optic cable housed in one embodiment of a carrier conduit.
Figure 10:
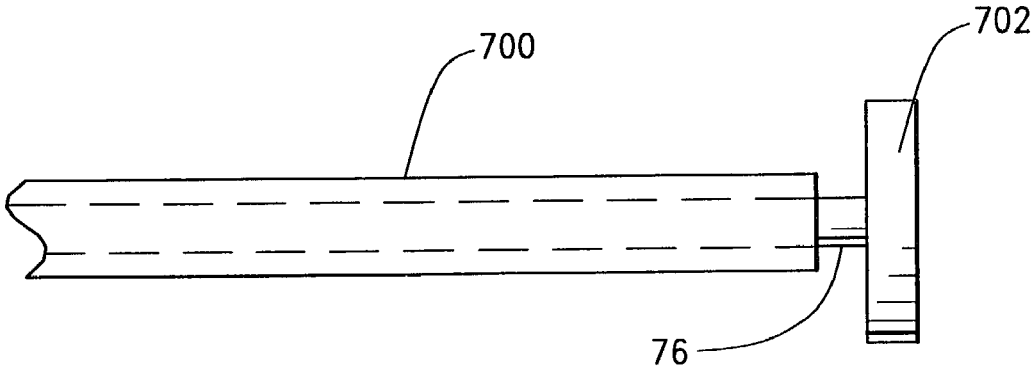
FIG. 10 represents a leading end of a fiber optic cable to which a drag member is connected and about which another embodiment of carrier conduit is disposed.

Such fiber optic cable can include, but need not have, some additional covering. One example is a thin metallic or other durable composition carrier conduit that facilitates insertion of the fiber optic cable into the well or the formation. For example, the end of the fiber optic cable to be projected into the formation can be embedded in a very thin metal tube to reinforce this portion of the optical fiber (such as to prevent bending past a mechanical or optical critical radius) and yet to allow compression of the fiber in response to formation pressure, for example. As another example, the fiber and the carrier conduit can be moveable relative to each other so that inside the formation the carrier conduit can be at least partially withdrawn to expose the fiber. Such a carrier conduit includes both fully and partially encircling or enclosing configurations about the fiber. Referring to FIG. 9, a particular implementation can include a titanium open or closed channel member 600 having a pointed tip 600*a* and carrying the end of an optical fiber 66. Another example, shown in FIG. 10, is to have a drag member 702 attached to the end of an optical fiber 76 and to have a carrier conduit 700 behind it, whereby the transporting fluid engages the drag member 702 when emplacing the fiber optic cable 76 but whereby the carrier conduit 700 can be withdrawn (at least partially) once the fiber optic cable 76 with the drag member 702 is in place and held by surrounding proppant, for example.

To use the spooling configuration referred to above, fiber optic cable is preferably coiled in a manner that does not exceed at least the mechanical critical radius for the fiber optic cable and that freely unspools or uncoils as the fiber optic cable is moved into the well. A somewhat analogous example is a spool of fishing line. The use of the term "spool" or the like does not imply the use of a rotatable cylinder but rather at least a compact form of the fiber optic cable that readily releases upon being pulled into the well. With regard to fiber optic cable spooling, see for example U.S. Pat. No. 6,041,872 to Holcomb, incorporated in its entirety herein by reference.

Non-limiting examples of optical sensors 364, 464, 564 that can be used for the aforementioned embodiments include a pressure sensor, a cable strain sensor, a microbending sensor, a chemical sensor, or a spectrographic sensor. Preferably these operate directly within the optical domain (for example, a chemical coating that swells in the presence of a chemical to be sensed, which swelling applies a pressure to an optical fiber to which the coating is applied and thereby affects the optical signal); however, others that require conversion to an optical signal can be used. Non-limiting examples of specific optical embodiments include fiber Bragg gratings and long period gratings.

Although the foregoing has been described with reference to one treatment in a well, the present invention can be used with multiple treatments in a single run, such as with a COBRA FRAC stimulation service treatment, for example. Furthermore, multiple spools or other sources of fiber optic cable can be used. When multiple fiber optic cables or spools are used, they can be used in combination or respectively, such as by dedicating one or more to respective zones of treatment.

Although the foregoing has been described with regard to optical fiber technology, broadest aspects of the present invention encompass other conductive fibers and technologies, including conductive carbon nanotubes. Broadly, the conductive fiber may be defined to conduct one or more forms of energies, such as optical, electrical, or acoustic, as well as changes in the conducted energy induced by parameters in the formation. Thus, the conductive fiber of the present invention can include one or more of optical fiber, electrical conductor (including, for example, wire), and acoustical waveguide.

In general, those skilled in the art know specific equipment and techniques with which to implement the present invention.

Thus, the present invention is well adapted to carry out objects and attain ends and advantages apparent from the foregoing disclosure. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A method of sensing at least one parameter in a formation communicating with a wellbore, comprising the step of moving a portion of at least one fiber optic cable from the wellbore into the formation by flowing a fluid into the formation, and carrying by the flowing fluid the portion of at least one fiber optic cable into the formation such that the portion is placed to conduct an optical signal responsive to the at least one parameter in the formation.

2. The method as defined in claim 1, wherein the step of flowing the fluid into the formation includes the steps of:

creating a fracture in the formation with the fluid; and transporting proppant into the fracture as part of the fluid.

3. The method as defined in claim 2, wherein the at least one fiber optic cable has an outer diameter smaller than an outer diameter of whole particles of the proppant.

4. The method as defined in claim 1, wherein the step of carrying the portion of at least one fiber optic cable includes the step of pulling fiber optic cable from a spool thereof by using the force of the flowing fluid engaging the at least one fiber optic cable.

5. The method as defined in claim 4, wherein the spool of fiber optic cable is disposed in the wellbore.

6. The method as defined in claim 4, wherein the spool of fiber optic cable is outside the wellbore.

7. The method as defined in claim 1, wherein the step of flowing a fluid into the formation comprises:

flowing a fluid into a fracture in the formation; and carrying by the flowing fluid the portion of at least one fiber optic cable into the fracture.

8. The method as defined in claim 1, wherein the step of moving the portion of at least one fiber optic cable includes the steps of:

moving a carrier conduit into the formation; and carrying the portion of at least one fiber optic cable into the formation in the carrier conduit.

9. The method as defined in claim 1, wherein the at least one fiber optic cable includes at least one sensor to measure at least one of a physical characteristic, chemical composition, material property, or disposition of the formation.

10. A method of sensing at least one parameter in a formation intersected by a wellbore, comprising the steps of:

moving a fiber optic sensor from the wellbore into the formation outside the wellbore;

conducting light to the fiber optic sensor from a light source; and receiving an optical signal from the fiber optic sensor in response to the conducted light and at least one parameter in the formation.

11. The method as defined in claim 10, wherein the step of moving the fiber optic sensor includes the step of pumping a fluid into the wellbore, wherein the fluid is selected from the group consisting of a fracturing fluid, an acidizing fluid, and a conformance fluid.

12. The method as defined in claim 10, wherein the step of moving the fiber optic sensor includes the steps of:

moving a carrier conduit into the formation; and carrying the fiber optic sensor into the formation in the carrier conduit.

13. The method as defined in claim 10, wherein the light source is disposed in the wellbore.

14. The method as defined in claim 10, wherein the light source is disposed outside the wellbore.

15. The method as defined in claim 10, wherein the optical signal is received in the wellbore.

16. The method as defined in claim 10, wherein the optical signal is received outside the wellbore.

17. The method as defined in claim 10, wherein the fiber optic sensor is hydraulically moved through a perforation in a casing or lining disposed in the wellbore.

18. The method as defined in claim 10, wherein the fiber optic sensor is hydraulically moved into a fracture formed in the formation.

19. The method as defined in claim 10, wherein the fiber optic sensor is carried in a carrier conduit that is moved through a perforation in a casing or lining disposed in the wellbore.

20. The method as defined in claim 10, wherein the fiber optic sensor is carried in a carrier conduit that is moved into a fracture formed in the formation.

21. The method as defined in claim 10, wherein the step of moving the fiber optic sensor includes the step of transporting proppant into the formation with the fiber optic sensor, wherein the fiber optic sensor has an outer diameter smaller than an outer diameter of whole particles of the proppant.

22. The method as defined in claim 10, wherein the step of moving the fiber optic sensor includes the step of pulling fiber optic cable from a spool thereof by using the force of flowing fluid engaging the fiber optic cable.

23. The method as defined in claim 22, wherein the spool of fiber optic cable is disposed in the wellbore.

24. The method as defined in claim 22, wherein the spool of fiber optic cable is outside the wellbore.

25. The method as defined in claim 10, wherein the step of moving the fiber optic sensor includes the steps of:

fracturing the formation with a fluid under pressure; and moving the fiber optic sensor with the fluid.

26. The method as defined in claim 10, wherein the step of moving the fiber optic sensor includes the step of pumping a fluid such that the fluid fractures the formation and the fluid engages and pulls the fiber optic sensor.

27. A method of treating a well, comprising the step of:

using, during a treatment time period, a process selected from the group consisting of a fracturing process, an acidizing process, and a conformance process;

moving a fiber optic sensor into a formation undergoing the treatment; and sensing with the fiber optic sensor at least one parameter of the formation.

28. The method as defined in claim 27, further comprising the step of leaving the fiber optic sensor in the formation after the treatment time period to degrade such that the fiber optic sensor has a useful life only during the treatment time period.

29. The method as defined in claim 27, wherein the step of moving the fiber optic sensor includes pumping the fiber optic sensor with a fluid used in the process.

30. The method as defined in claim 27, wherein the step of moving the fiber optic sensor includes the step of transporting the fiber optic sensor within a carrier conduit that is moved into the formation with the fiber optic sensor.

31. A method of sensing at least one parameter in a formation communicating with a wellbore, comprising the step of moving a portion of at least one conductive fiber from the wellbore into the formation by flowing a fluid into the formation, and carrying by the flowing fluid the portion of at least one conductive fiber into the formation such that the portion is placed to conduct a signal responsive to the at least one parameter in the formation.

32. The method as defined in claim 31, wherein the step of flowing a fluid into the formation includes the steps of:

creating a fracture in the formation with the fluid; and transporting proppant into the fracture as part of the fluid.

33. The method as defined in claim 32, wherein the at least one conductive fiber has an outer diameter smaller than an outer diameter of whole particles of the proppant.

34. The method as defined in claim 31, wherein the step of carrying the portion of at least one conductive fiber includes the step of pulling fiber optic cable from a spool thereof by using the force of the flowing fluid engaging the fiber optic cable.

35. The method as defined in claim 34, wherein the spool of fiber optic cable is disposed in the wellbore.

36. The method as defined in claim 34, wherein the spool of fiber optic cable is outside the wellbore.

37. The method as defined in claim 31, wherein the step of flowing a fluid into the formation comprises:

flowing a fluid into a fracture in the formation; and carrying by the flowing fluid the portion of at least one conductive fiber into the fracture.

38. The method as defined in claim 31, wherein the step of moving the portion of at least one conductive fiber includes the steps of:

moving a carrier conduit into the formation; and carrying the portion of at least one conductive fiber into the formation in the carrier conduit.

39. The method as defined in claim 31, wherein the at least one conductive fiber includes at least one sensor to measure at least one of a physical characteristic, chemical composition, material property, or disposition of the formation.

40. The method as defined in claim 31, wherein the at least one conductive fiber includes an optical fiber.

41. The method as defined in claim 31, wherein the at least one conductive fiber includes an electrical conductor.

42. The method as defined in claim 31, wherein the at least one conductive fiber includes conductive carbon nanotubes.

43. The method as defined in claim 31, wherein the at least one conductive fiber includes an acoustical conductor.

* * * * *